US008904796B2

(12) United States Patent
Singh

(10) Patent No.: US 8,904,796 B2
(45) Date of Patent: Dec. 9, 2014

(54) FLASHBACK RESISTANT TUBES FOR LATE LEAN INJECTOR AND METHOD FOR FORMING THE TUBES

(75) Inventor: Arjun Singh, Madhya Pradesh (IN)

(73) Assignee: General Electric Company, Schenectady, NY (US)

( * ) Notice: Subject to any disclaimer, the term of this patent is extended or adjusted under 35 U.S.C. 154(b) by 508 days.

(21) Appl. No.: 13/276,572

(22) Filed: Oct. 19, 2011

(65) Prior Publication Data

US 2013/0098044 A1 Apr. 25, 2013

(51) Int. Cl.

| | |
|---|---|
| ***F02C 1/00*** | (2006.01) |
| ***F02G 3/00*** | (2006.01) |
| ***F23R 3/34*** | (2006.01) |
| ***F23R 3/04*** | (2006.01) |
| *F01D 9/02* | (2006.01) |

(52) U.S. Cl.

CPC . *F23R 3/346* (2013.01); *F23R 3/34* (2013.01); *F01D 9/023* (2013.01); *F23R 3/045* (2013.01)

USPC ..... 60/733; 60/746

(58) Field of Classification Search

CPC ..... F23R 3/34; F23R 3/346; F23R 3/286; F02C 7/228; F01D 9/023

USPC ..... 60/732, 733, 737, 738, 746, 747, 740, 60/742, 739; 239/533.2

See application file for complete search history.

(56) References Cited

U.S. PATENT DOCUMENTS

| | | | | |
|---|---|---|---|---|
| 5,265,425 | A * | 11/1993 | Howell | 60/736 |
| 5,749,219 | A * | 5/1998 | DuBell | 60/804 |
| 5,850,731 | A * | 12/1998 | Beebe et al. | 60/778 |
| 6,047,550 | A * | 4/2000 | Beebe | 60/737 |
| 6,192,688 | B1 * | 2/2001 | Beebe | 60/723 |
| 7,677,472 | B2 | 3/2010 | Hessler | |
| 7,886,546 | B2 | 2/2011 | Wobben | |
| 8,112,216 | B2 * | 2/2012 | Davis et al. | 701/100 |
| 8,275,533 | B2 * | 9/2012 | Davis et al. | 701/100 |
| 8,281,594 | B2 * | 10/2012 | Wiebe | 60/733 |
| 8,381,532 | B2 * | 2/2013 | Berry et al. | 60/795 |
| 8,457,861 | B2 * | 6/2013 | Davis et al. | 701/100 |
| 8,545,215 | B2 * | 10/2013 | Bhagat | 431/173 |
| 2008/0264033 | A1 * | 10/2008 | Lacy et al. | 60/39.49 |
| 2009/0084082 | A1 * | 4/2009 | Martin et al. | 60/39.281 |
| 2010/0170216 | A1 * | 7/2010 | Venkataraman et al. | 60/39.37 |
| 2010/0170219 | A1 * | 7/2010 | Venkataraman et al. | 60/39.281 |
| 2010/0170251 | A1 * | 7/2010 | Davis et al. | 60/740 |
| 2010/0170252 | A1 * | 7/2010 | Venkataraman et al. | 60/742 |
| 2010/0170254 | A1 * | 7/2010 | Venkataraman et al. | 60/746 |
| 2010/0174466 | A1 * | 7/2010 | Davis et al. | 701/100 |
| 2011/0067402 | A1 * | 3/2011 | Wiebe et al. | 60/740 |
| 2011/0179803 | A1 * | 7/2011 | Berry et al. | 60/785 |
| 2011/0289928 | A1 * | 12/2011 | Fox et al. | 60/740 |
| 2012/0110974 | A1 * | 5/2012 | Davis et al. | 60/39.463 |
| 2012/0312024 | A1 * | 12/2012 | Davis et al. | 60/772 |
| 2013/0025289 | A1 * | 1/2013 | Citeno et al. | 60/772 |
| 2013/0031908 | A1 * | 2/2013 | DiCintio et al. | 60/752 |

(Continued)

*Primary Examiner* — William H Rodriguez

(74) *Attorney, Agent, or Firm* — Nixon & Vanderhye P.C.

(57) ABSTRACT

A late lean fuel injection nozzle for a gas turbine includes a first outer air supply tube having a relatively large inner diameter and an outlet at a distal end thereof. The first outer air supply tube is adapted to supply air to a combustion chamber, and at least one fuel injection tube having a relatively smaller diameter enters a distal end portion of the first outer air supply tube and extends within the first outer air supply tube substantially to the outlet.

20 Claims, 4 Drawing Sheets

(56) References Cited

U.S. PATENT DOCUMENTS

2013/0174558 A1* 7/2013 Stryapunin ..... 60/734
2013/0239575 A1* 9/2013 Chen et al. ..... 60/747
2013/0283801 A1* 10/2013 Romig et al. ..... 60/733
2014/0013723 A1* 1/2014 Melton et al. ..... 60/39.48
2014/0033725 A1* 2/2014 Chen et al. ..... 60/740

* cited by examiner

FLASHBACK RESISTANT TUBES FOR LATE LEAN INJECTOR AND METHOD FOR FORMING THE TUBES

BACKGROUND OF THE INVENTION

This invention relates to gas turbine combustion technology and more particularly, to late-lean-injection fuel injector configurations.

Currently, some gas turbine engines fail to operate at high efficiency and produce undesirable air-polluting emissions. The primary air-polluting emissions usually produced by turbines burning conventional hydrocarbon fuels are oxides of nitrogen, carbon monoxide and unburned hydrocarbons. To this end, since oxidation of, e.g., molecular nitrogen, in gas turbine engines is dependent upon a high temperature in the combustor and the residence time for the reactants at the high temperature within the combustor, the level of thermal NOx formation is reduced by maintaining the combustor temperature below the level at which thermal NOx is formed or by limiting the residence time for the reactants at the high temperatures such that there is insufficient time for the NOx formations to progress.

One temperature-controlling method involves premixing of fuel and air to form a lean mixture prior to combustion. However, it has been seen that for heavy duty industrial gas turbines, even with the use of premixed lean fuels, the required temperatures of the combustion products are so high that the combustor must be operated with a peak gas temperature in the reaction zone that exceeds the thermal NOx formation threshold temperature, resulting in significant NOx formation.

Late lean injection (LLI) techniques have been developed to reduce NOx formation. Specifically, the purpose of LLI is to reduce NOx formation by reducing the residence time of fuel and air within the combustor. This is achieved by injecting a portion of the fuel and air into the combustor at a location downstream of the main combustion zone. In this way, the LLI fuel and air are combusted but do not travel as far through the combustor. As such, as long as sufficient fuel and air mixing occurs, the LLI fuel and air generally do not form as much NOx as would otherwise be produced.

In the implementation of LLI, tube-in-tube injectors may be employed, as described, for example, in U.S. 2010/0170216 A1. Such injectors actively feed fuel to the interior of the transition zone between the combustor and the turbine. The injectors include a fuel injection tube extending along and through a larger diameter tube or sleeve through which air is passively fed to the transition zone. The presently configured LLI injectors, however, give rise to potential flashback problems where ignited gas in the transition zone enters the LLI injector nozzles.

There remains a need for more efficient LLI fuel injectors that produce lesser NOx and which provide greater flashback resistance.

BRIEF DESCRIPTION OF THE INVENTION

In one exemplary but nonlimiting aspect, the present invention provides a late lean fuel injection nozzle for a gas turbine comprising a first outer tube having a relatively large inner diameter and an outlet at a distal end thereof, the first outer tube adapted to supply air to a combustion chamber; and at least one fuel injection tube having relatively smaller diameter entering a distal end portion of the first outer tube and extending within the first outer tube substantially to the outlet, the at least one fuel injection tube adapted to supply fuel to the combustion chamber.

In another nonlimiting aspect, the invention provides a gas turbine combustor comprising a combustor liner defining a first combustion chamber, a transition duct connected to an aft end of the combustor liner, the transition duct providing a second combustion chamber; at least one late lean fuel injector projecting through the transition duct and into the second combustion chamber, the at least one late lean fuel injector comprising a first outer air supply tube having a relatively large inner diameter and an outlet at a distal end thereof within the second combustion chamber, and at least one fuel injection tube having relatively smaller diameter entering a distal end portion of the first outer air supply tube adjacent an outside surface of the transition duct and extending within the first outer air supply tube substantially to the outlet, such that air flowing through the first outer air supply tube is substantially unobstructed.

In still another nonlimiting aspect, the invention provides a method of forming and assembling a late lean fuel injector in a transition duct of a late lean gas turbine combustor comprising providing a first outer air supply tube having an outlet adapted to supply air to a secondary combustion chamber in a late lean combustor configuration; providing at least one fuel injection tube having a first portion that enters the first outer air supply tube substantially laterally at a distal end of the first outer air supply tube and a second portion that extends within the first outer air supply tube to the outlet; and assembling the late lean fuel injection nozzle to the transition duct such that the first outer air supply tube and the at least one fuel injection tube penetrate the transition duct, with the first portion of the fuel injection tube extending along an outer surface of the transition duct.

The invention will be described in greater detail in conjunction with the drawings identified below.

DETAILED DESCRIPTION OF THE INVENTION

Figure 1:
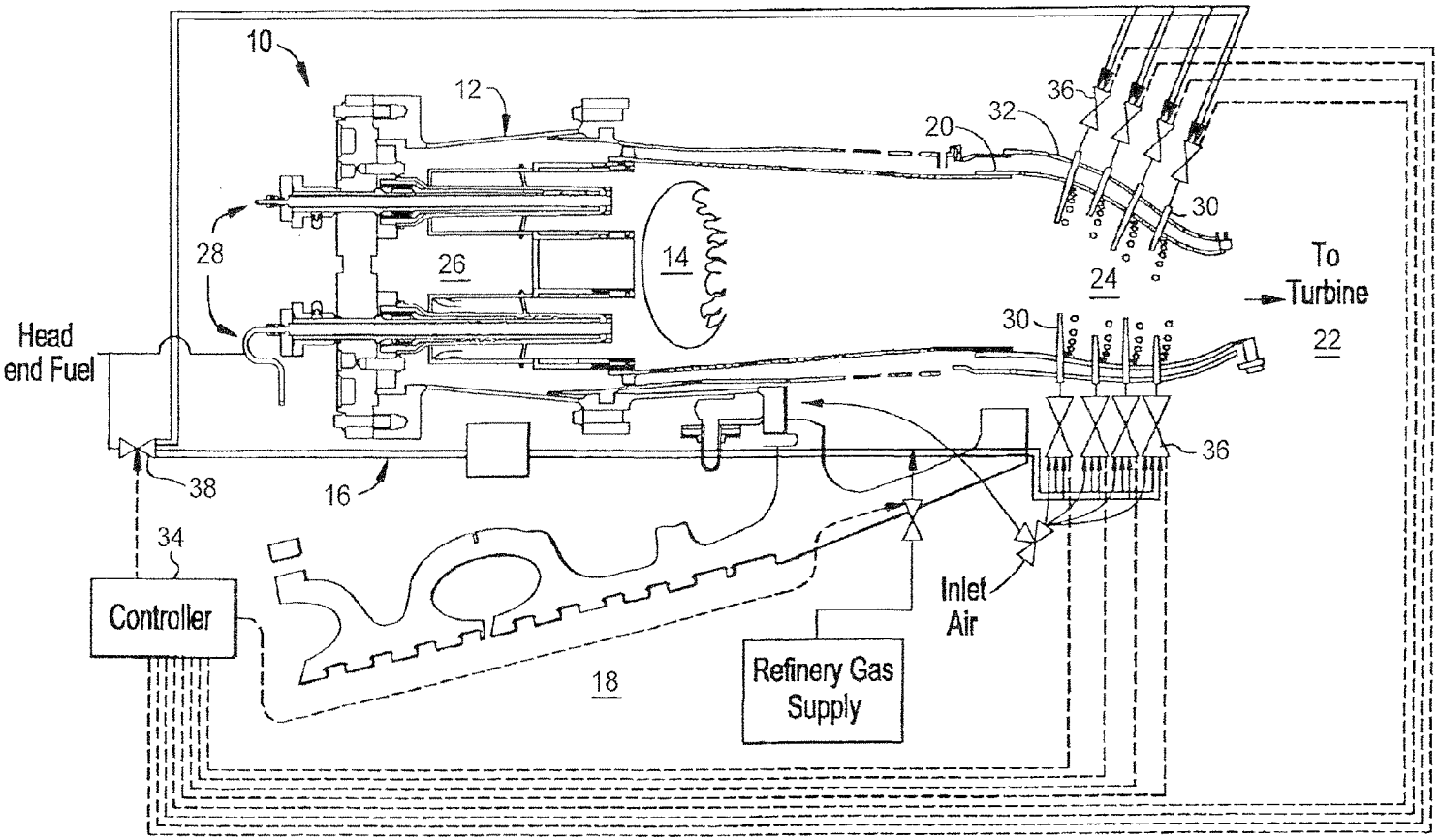
FIG. 1 is a partial side sectional view of a turbine configuration provided with late-lean-injection capability.

With reference to FIG. 1, a gas turbine engine 10 is illustrated that includes a combustor 12 having a first combustion zone or chamber 14 in which a first fuel, supplied by fuel circuit 16, is combusted; a compressor 18 where inlet air is compressed and provided to at least the combustor; and a transition duct 20 connecting the combustor 12 to the turbine 22. Rotating turbine blades or buckets are mounted on the turbine rotor wheels or disks (not shown), and the products of at least the combustion of the first fuel are directed through the transition duct 20 to power rotation of the turbine blades. The transition duct 20 provides a second combustion zone or chamber 24 in which a second fuel, supplied by the fuel circuit 16, and the products of combustion of the first fuel are combusted. As shown, the first combustion zone or chamber 14 and the second combustion zone or chamber 24 in the transition zone or duct 20 combine with one another to form a head end 26, which may have various configurations as will be discussed below.

As shown in FIG. 1, the head end 26 may include multiple premixing nozzles 28. However, other head end configurations are possible. Such alternate configurations include, but are not limited to the standard combustor configurations, the Dry Low NOx (DLN) 1+ combustor configuration and the DLN 2+ combustor configuration. Still other combustor configurations include Integrated Gasification Combined Cycle (IGCC) head ends, catalytic head ends, diffusion style head ends and Multi-Nozzle Quiet Combustion (MNQC) style head ends.

For each of the above-noted head end configurations, it is understood that they may be made LLI compatible. In the LLI arrangement of FIG. 1, a plurality of LLI fuel injectors 30 are each structurally supported by an exterior wall of the transition duct 20 or by an exterior wall of an impingement sleeve 32 surrounding the transition duct 20. The LLI fuel injectors 30 extend into the second combustion chamber 24 to varying depths and are thus configured to provide LLI fuel staging capability. That is, the fuel injectors are each configured to supply the second fuel (i.e., LLI fuel) to the second combustion chamber 24 by fuel injection in a direction that is generally transverse to a predominant flow direction through the transition duct 20, in any one of a single axial stage, multiple axial stages, a single axial circumferential stage or multiple axial circumferential stages. In so doing, conditions within the combustor and the transition duct are staged to create local zones of stable combustion.

LLI fuel staging is controlled by a controller 34 that communicates with valves 36 which admit fuel from the fuel circuit 16 to the injectors 30 via fuel circuit valve 38. This LLI combustor configuration is further described in commonly-owned U.S. Publication No. 2010/0170251.

Figure 2:
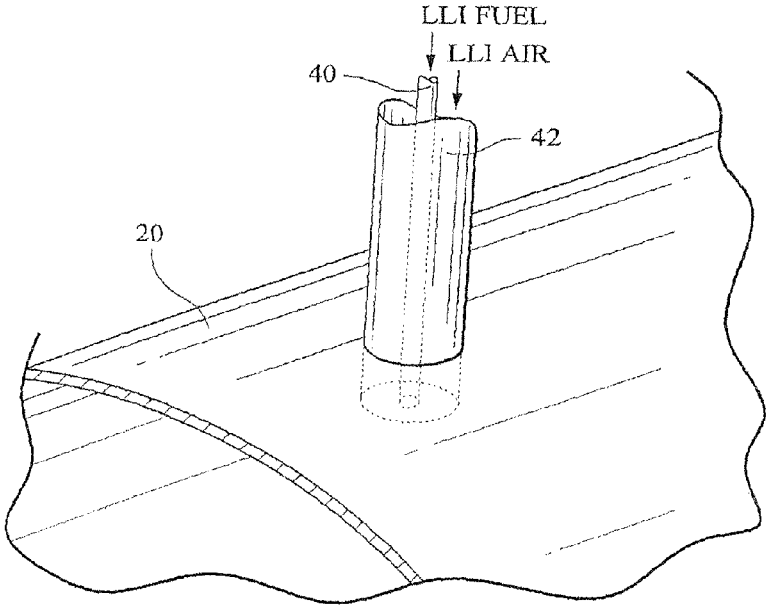
Figure 2 (Prior Art)
FIG. 2 is a partial perspective view of a known LLI fuel injector extending into a combustor transition duct.

FIG. 2 illustrates a known single tube-in-tube LLI fuel injector 30. In this configuration, fuel is actively fed to the interior chamber 24 of the transition duct 20 through a nozzle (not shown) at the distal end of a single fuel injection fuel injection tube 40 extending perpendicular to the longitudinal axis of the transition piece, and air is passively fed through the annular space between the fuel injection tube 40 and an outer sleeve or tube 42 which also extends into the duct. In a typical arrangement, as many as ten LLI fuel injectors 30 are arranged about the transition piece, each enclosing a single fuel injection tube 40.

Figure 3:
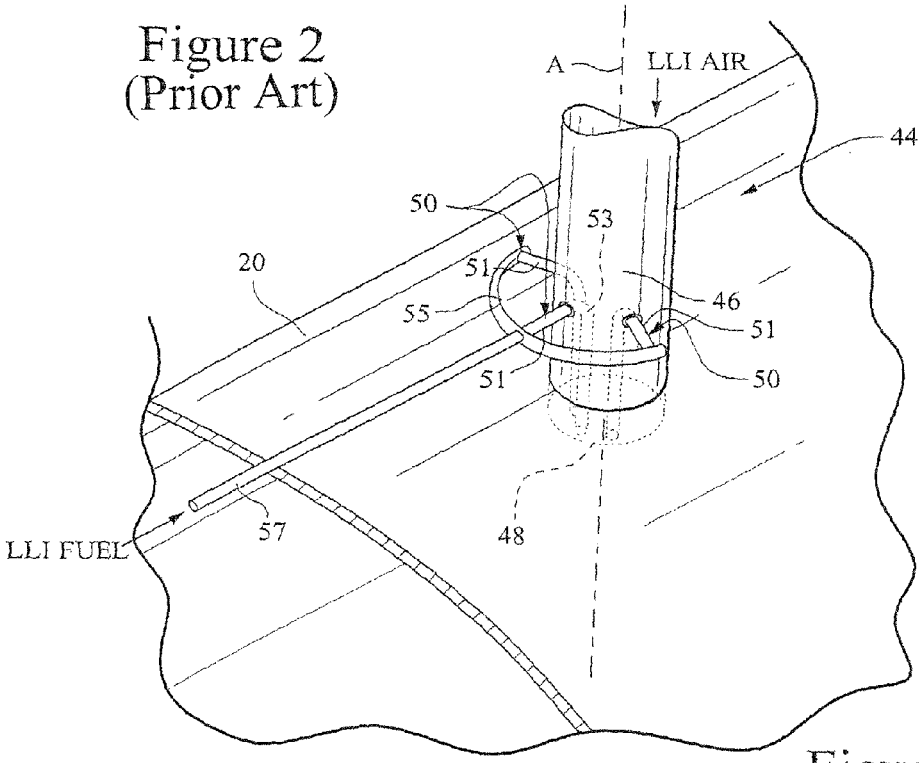
FIG. 3 is a partial perspective view of an LLI fuel injector in accordance with a first exemplary but nonlimiting embodiment of the invention.

FIG. 3 illustrates an LLI fuel injector 44 in accordance with a first exemplary but nonlimiting embodiment. The LLI fuel injector 44 includes an elongated first outer sleeve or tube 46 that penetrates the transition duct 20, terminating at an outlet 48. A plurality of smaller-diameter fuel injection tubes 50 enter the first outer sleeve or tube 46 (also referred to as an outer air supply tube) substantially radially at locations outside but proximate the transition duct wall, and extend axially through the sleeve or tube 46 to the outlet 48. The fuel injection tube nozzles or orifices (not shown) are located substantially flush with the outer tube outlet 48. More specifically, a first portion of each of the fuel injection tubes 50 enters the first outer air supply tube 46 at an angle of substantially ninety degrees to the longitudinal axis A of the outer air supply tube 46, bending inside the outer tube 46 to form a second portion 53 extending substantially parallel to the longitudinal axis A of the sleeve or tube 46 to the outlet 48. The tubes 50 may be connected to a common manifold or fuel chamber 55 supplied with LLI fuel via a supply pipe 57 that extends substantially parallel to the longitudinal axis of the transition piece 20. Mechanical vibration of the fuel injection tubes 50 can be addressed by installing rubber (or other suitable material) washers (not shown) at the interface between the fuel injection tubes 50 and the respective outer air supply tube 46. It will also be appreciated that while the injection tubes 50 extend axially inside the radially outer air supply tube 46, both the outer air supply 46 and the injection tubes 50 extend substantially radially into the transition duct 20. By limiting the extent of the obstruction to LLI air flow in the outer tube air supply 46, and by minimizing the exposure of the fuel in the fuel injection tubes 50 to the second combustion chamber 24 by locating them close to the transition duct with a ninety degree bend close to the outlet 48, flashback resistance is enhanced. In addition, because there is substantially no obstruction to the flow of the LLI air flow for a significant portion of the length of the outer air supply tube 46, pressure drop is reduced. In addition, supply of fuel to the outer air supply tube 46 via the fuel injection tubes 50 and a suitable common manifold is simplified.

Where multiple fuel injection tubes 50 are employed as in the arrangement shown in FIG. 3, the fuel injection tubes are preferably arranged in an arc about the interior of the outer thereof tube 46, and proximate the interior surface air supply, i.e., the tubes are located away from the center of the outer air supply tube to allow substantially unobstructed airflow through the tube 46. Utilizing plural small-diameter fuel injection tubes 50 permits more fuel to be supplied to the second combustion chamber while still providing enhanced flashback resistance.

Figure 4:
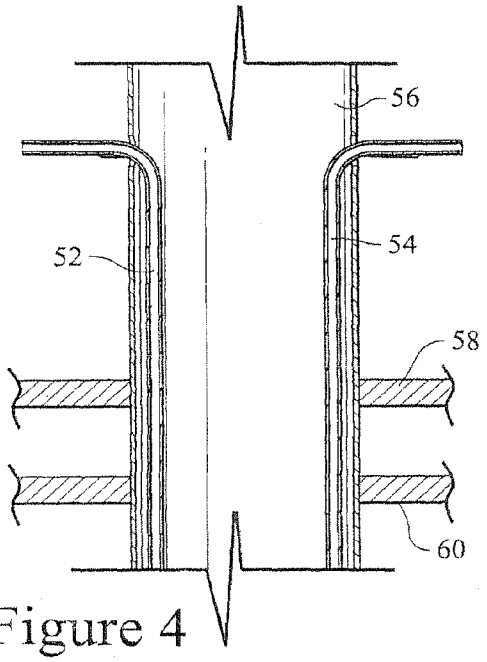
FIG. 4 is a partial section of an LLI fuel injector extending through an impingement sleeve and transition duct in accordance with another exemplary but nonlimiting embodiment.

FIG. 4 illustrates a pair of diametrically-opposed fuel injection tubes 52, 54 within the outer LLI fuel injector air supply tube 56. FIG. 4 also illustrates the tube 56 penetrating both an impingement sleeve 58 and the transition duct 20. The arrangement of an impingement sleeve about a transition duct per se is well known in the art.

Figure 5:
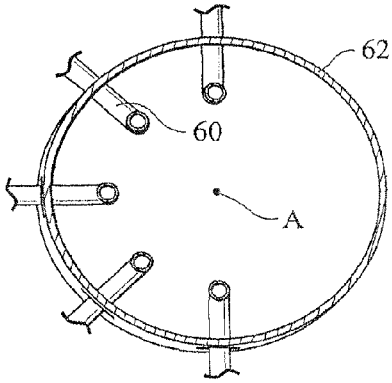
FIG. 5 is a simplified section through a transition duct of reduced scale, showing a semi-circular array of LLI fuel injector nozzles within the LLI injector in accordance with the invention.
Figure 6:
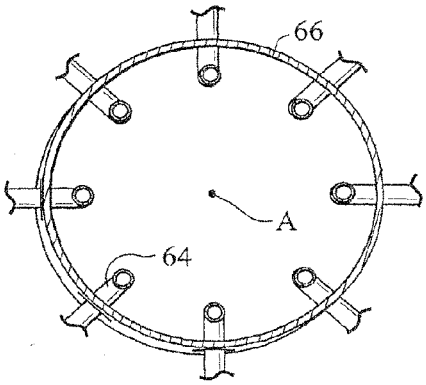
FIG. 6 is a view similar to FIG. 5 but showing a circular array of LLI fuel injector nozzles within the LLI injector in accordance with the invention.

FIG. 5 illustrates a semi-circular array of five fuel injection tubes 60 within an LLI fuel injector air supply tube 62, while FIG. 6 illustrates a full circular array of eight fuel injection tubes 64 within an LLI fuel injector air supply tube 66.

For the arrangements shown in FIGS. 4-6, it is contemplated that a single fuel supply line would extend to an arcuate or annular manifold from which the fuel injection tubes extend as shown in FIG. 3.

Figure 7:
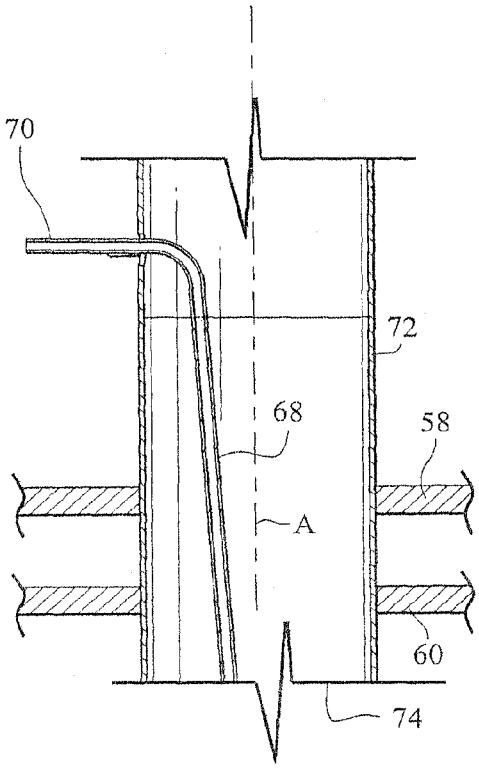
FIG. 7 is a view similar to FIG. 4 but showing a slanted fuel injector nozzle within the LLI injector.

FIG. 7 illustrates an alternative arrangement where the second portion 68 of a fuel injection tube 70 that lies within the FFI fuel injector outer air supply tube 72 is angled toward the longitudinal axis A of the tube 72 in a direction towards the outlet 74 of the LLI fuel injector. The second portion 68 of the fuel injection tube 70 may be oriented at an angle of from about 3 to 10 degrees, and preferably about 5 degrees, relative to the longitudinal axis A.

Figure 8:
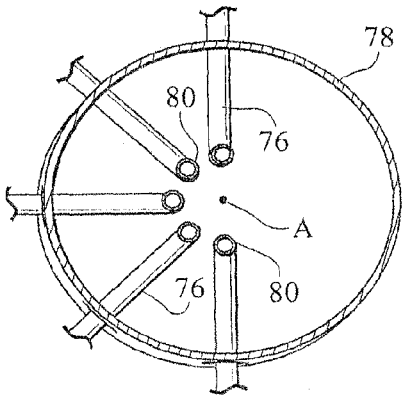
FIG. 8 is a view similar to FIGS. 5 and 6 but showing a semi-circular array of slanted fuel injection nozzles within the LLI injector.

FIG. 8 illustrates a semi-circular array of five fuel injection tubes 76 within an LLI fuel injector outer air supply tube 78, all of which have second portions 80 that are substantially uniformly angled toward the longitudinal axis A of the tube 78 in a direction towards the outlet of the LLI fuel injector.

It has been determined that employing five fuel injection tubes 76 at substantially a 5° angle to the longitudinal axis A of the outer air supply tube 78 provides the most benefit in terms of NOx reduction. It is also advantageous to arrange the five fuel injection tubes 76 in an arcuate array at the head end of the LLI fuel injector 30 (i.e., at the end closest the head end of the combustor) to simplify the fuel feed/manifold arrangement. In addition, by slanting the fuel injection tubes 76 toward the longitudinal axis A, the fuel enters the second combustion chamber 24 further downstream of the first combustion chamber, resulting in lower combustion temperatures in the second combustion chamber, and hence lowers NOx emissions.

Exemplary but nonlimiting diameters for the outer air supply tube of the LLI fuel injectors described herein may be in the range of from about 0.80 in. to about 2.0 in., while diameters of the fuel injection tubes may be in the range of from about 0.10 to about 0.25 in. All dimensions, including the fuel supply line and manifold, are understood to be application specific and may vary as required.

The exemplary but nonlimiting embodiments, particularly those employing plural fuel injection tubes within the LLI fuel injector outer air supply sleeve or tube, advantageously provide both enhanced flashback resistance and reduced NOx emissions, while also permitting less complex fuel delivery arrangements.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A late lean fuel injection nozzle for a transition duct of a combustor for a gas turbine comprising:

a first outer tube having a sidewall defining an inner diameter and an outlet at a distal end thereof, said first outer tube adapted to supply air to a combustion chamber and configured to extend into the transition duct and project into the combustion chamber; and at least one fuel injection tube having a diameter smaller than the inner diameter of the first outer tube, the at least one fuel injection tube including an inlet section extending through the sidewall and entering a distal end portion of said first outer tube, an outlet section extending within said first outer tube substantially to said outlet, and a bended section between the inlet section and the outlet section, said at least one fuel injection tube adapted to supply fuel through an outlet in the outlet section to the combustion chamber.

2. The late lean fuel injection nozzle of claim 1 wherein the outlet section of said at least one fuel injection tube extends within said first outer tube closely adjacent an inner wall of said first outer tube.

3. The late lean fuel injection nozzle of claim 1 wherein the outlet section of said at least one fuel injection tube extends within said first outer tube at an angle to a longitudinal axis of said first outer tube.

4. The late lean fuel injection nozzle of claim 1 wherein said at least one fuel injection tube comprises between three and eight fuel injection tubes.

5. The late lean fuel injection nozzle of claim 4 wherein the outlet section of each of said fuel injection tubes extends within said outer tube substantially parallel to a longitudinal axis of said first outer tube.

6. The late lean fuel injection nozzle of claim 4 wherein the outlet section of each of said fuel injection tubes extends within said outer tube at an angle to a longitudinal axis of said first outer tube.

7. The late lean fuel injection nozzle of claim 6 wherein said outlet sections of said fuel injection tubes are angled toward said longitudinal axis in a direction toward said outlet, said angle between about 3 and about 10 degrees.

8. The late lean fuel injection nozzle of claim 4 wherein said fuel injection tubes are arranged in an arcuate array within said first outer tube.

9. A late lean fuel injection nozzle for a gas turbine comprising:

a first outer tube having an inner diameter and an outlet at a distal end thereof, said first outer tube adapted to supply air to a combustion chamber; and at least three to eight fuel injection tubes each having a diameter smaller than the inner diameter of the first outer tube, wherein the fuel injection tubes enter a distal end portion of said first outer tube and extend within said first outer tube substantially to said outlet, said fuel injection tubes are adapted to supply fuel to the combustion chamber, wherein said fuel injection tubes enter said first outer tube substantially perpendicularly to a longitudinal axis of said first outer tube.

10. A gas turbine combustor comprising a combustor liner defining a first combustion chamber, a transition duct connected to an aft end of said combustor liner, said transition duct providing a second combustion chamber; at least one late lean fuel injector projecting through said transition duct and into said second combustion chamber, said at least one late lean fuel injector comprising a first outer air supply tube having a sidewall defining an inner diameter and an outlet at a distal end thereof within said second combustion chamber, and at least one fuel injection tube having a diameter smaller than the first outer air supply tube, wherein the at least one fuel injection tube includes:

an inlet section extending through the sidewall of the first outer air supply tube and entering a distal end portion of said first outer air supply tube adjacent an outside surface of said transition duct, an outlet section extending within said first outer air supply tube substantially to said outlet wherein the outlet section has a fuel outlet adjacent the outlet of the first outer air supply tube, and a bend section between the inlet section and the outlet section of the at least one fuel injection tube.

11. The gas turbine combustor of claim 10 wherein said at least one fuel injection tube comprises plural fuel injection tubes.

12. The gas turbine combustor of claim 11 wherein said outlet section of each of said plural fuel injection tubes extends within said first outer air supply tube substantially parallel to a longitudinal axis of said first outer air supply tube.

13. The gas turbine combustor of claim 11 wherein said outlet section of each of said plural fuel injection tubes extends within said first outer air supply tube at an angle to a longitudinal axis of said first outer air supply tube.

14. The gas turbine combustor of claim 13 wherein said outlet section of each of said plural fuel injection tubes is angled toward said longitudinal axis in a direction toward said outlet, said angle between about three and about ten degrees.

15. The gas turbine combustor of claim 11 wherein said plural fuel injection tubes comprise five fuel injection tubes with portions thereof located within said first outer air supply tube arranged in a semi-circular array.

16. The gas turbine combustor of claim 15 wherein said outlet section of each of said five fuel injection tubes extends at an angle of substantially five degrees to said longitudinal axis.

17. A method of forming and assembling a late lean fuel injector in a transition duct of a late lean gas turbine combustor comprising:

a. providing a first outer air supply tube having an outlet adapted to supply air to a secondary combustion chamber in a late lean combustor configuration;

b. providing at least one fuel injection tube having a first portion that enters said first outer air supply tube substantially laterally at a distal end of said first outer air supply tube and a second portion that extends within said first outer air supply tube to said outlet; and c. assembling said late lean fuel injection nozzle to said transition duct such that said first outer air supply tube and said at least one fuel injection tube penetrate said transition duct, with said first portion of said fuel injection tube extending along an outer surface of said transition duct.

18. The method of claim 17 wherein step b. includes providing plural of said fuel injection tubes with second portions thereof located within said first outer air supply tube in a semi-circular array adjacent an upstream side of said first outer air supply tube.

19. The method of claim 18 wherein said second portion of each of said plural fuel injection tubes extends substantially parallel to a longitudinal axis of said first outer air supply tube.

20. The method of claim 18 wherein said plural fuel injection tubes comprise between three and eight fuel injection tubes, and wherein said second portion of each of said plural fuel injection tubes extends at an angle of about 5 degrees toward a longitudinal axis of said first outer air supply tube in a direction toward said outlet.

* * * * *

UNITED STATES PATENT AND TRADEMARK OFFICE

CERTIFICATE OF CORRECTION

PATENT NO. : 8,904,796 B2
APPLICATION NO. : 13/276572
DATED : December 9, 2014
INVENTOR(S) : Singh It is certified that error appears in the above-identified patent and that said Letters Patent is hereby corrected as shown below:

In the Specification

At column 4, line 3, insert --51-- after "first portion"

At column 4, line 36, insert --46-- after "supply tube"

Signed and Sealed this
Tenth Day of March, 2015

Michelle K. Lee

Michelle K. Lee
*Deputy Director of the United States Patent and Trademark Office*